US007581258B2

(12) United States Patent
Baron et al.

(10) Patent No.: US 7,581,258 B2
(45) Date of Patent: Sep. 1, 2009

(54) ARTICLE OF APPAREL INCORPORATING A FLOCKED MATERIAL

(75) Inventors: Michael Robert Baron, Tigard, OR (US); Karin Elizabeth Carter, Portland, OR (US); Chia Pei C. Hung, Mt. Laurel, NJ (US); Carrie Lynn Davis, Portland, OR (US); Rebecca P. Hurd, Tigard, OR (US); LaShurya M. Wise, Portland, OR (US)

(73) Assignee: Nike, Inc., Beaverton, OR (US)

( * ) Notice: Subject to any disclaimer, the term of this patent is extended or adjusted under 35 U.S.C. 154(b) by 57 days.

(21) Appl. No.: 10/963,768

(22) Filed: Oct. 14, 2004

(65) Prior Publication Data

US 2006/0080755 A1 Apr. 20, 2006

(51) Int. Cl.
*A41D 13/00* (2006.01)

(52) U.S. Cl. ..... 2/69; 2/97; 2/168; 2/85; 442/59; 428/90

(58) Field of Classification Search ..... 2/85, 2/97, 168; 428/90; 442/59
See application file for complete search history.

(56) References Cited

U.S. PATENT DOCUMENTS

| | | | | |
|---|---|---|---|---|
| 2,916,036 | A * | 12/1959 | Sutton | 604/292 |
| 4,180,606 | A * | 12/1979 | Hance et al. | 428/88 |
| 4,267,219 | A * | 5/1981 | Ueno et al. | 428/90 |
| 4,390,387 | A * | 6/1983 | Mahn | 428/90 |
| 4,438,533 | A * | 3/1984 | Hefele | 2/97 |
| 4,757,557 | A * | 7/1988 | Hirano | 2/168 |
| 5,863,633 | A * | 1/1999 | Squires et al. | 428/90 |
| 5,981,021 | A * | 11/1999 | McCulloch | 428/97 |
| 6,350,504 | B1 * | 2/2002 | Alboom et al. | 428/88 |
| 2001/0008672 | A1 * | 7/2001 | Norvell et al. | 428/90 |
| 2004/0033743 | A1 * | 2/2004 | Worley et al. | 442/59 |
| 2005/0214501 | A1 * | 9/2005 | Baychar | 428/90 |

FOREIGN PATENT DOCUMENTS

| | | |
|---|---|---|
| FR | 2 846 202 | 4/2004 |
| GB | 1 265 002 | 3/1972 |
| WO | WO 97/34507 | 9/1997 |
| WO | WO 99/39038 | 8/1999 |

OTHER PUBLICATIONS

International Search Report in corresponding PCT application, International Application No. PCT/US2005/036006, mailed Feb. 28, 2006.

* cited by examiner

*Primary Examiner*—Gary L Welch
*Assistant Examiner*—Alissa J Tompkins
(74) *Attorney, Agent, or Firm*—Banner & Witcoff, Ltd.

(57) ABSTRACT

A flocked material and an article of apparel incorporating the flocked material are disclosed. The flocked material includes a substrate and a plurality of flocking fibers. The substrate is formed from a two-dimensional material and has a first surface and an opposite second surface. The flocking fibers are secured to the second surface. In addition, the flocking fibers may form a plurality of apertures that expose at least a portion of the second surface of the substrate. When incorporated into the article of apparel, the flocking fibers may face inward to form at least a portion of an interior surface of the article of apparel. Accordingly, the flocking fibers may be positioned to contact an individual wearing the article of apparel.

22 Claims, 6 Drawing Sheets

ARTICLE OF APPAREL INCORPORATING A FLOCKED MATERIAL

BACKGROUND OF THE INVENTION

1. Field of the Invention

The present invention relates to materials for articles of apparel. The invention concerns, more particularly, a flocked material that is suitable for use in articles of apparel. The invention has application, for example, to articles of apparel intended for use during athletic activities.

2. Description of Background Art

Articles of apparel designed for use during athletic activities generally exhibit characteristics that enhance the performance or comfort of an individual. For example, apparel may incorporate an elastic material that provides a relatively tight fit, thereby imparting the individual with a lower profile that minimizes wind resistance. Apparel may also be formed from a material that wicks moisture away from the individual in order to reduce the quantity of perspiration that accumulates adjacent to the skin. Furthermore, apparel may incorporate materials that are specifically selected for particular environmental conditions. Accordingly, materials incorporated into articles of apparel for athletic activities may be specifically selected to enhance the performance or comfort of the individual.

The characteristics of the materials that are incorporated into an article of apparel are generally selected based upon the specific activity for which the article of apparel is intended to be used. A material that minimizes wind resistance, for example, may be suitable for activities where speed is a primary concern. Similarly, a material that reduces the quantity of perspiration that accumulates adjacent to the skin may be most appropriate for athletic activities commonly associated with a relatively high degree of exertion. Accordingly, materials may be selected to enhance the performance or comfort of individuals engaged in specific athletic activities.

Textiles area a commonly-utilized class of materials for articles of apparel. Textiles may be defined as any manufacture from fibers, filaments, or yarns characterized by flexibility, fineness, and a high ratio of length to thickness. Textiles generally fall into two categories. The first category includes textiles produced directly from webs of fibers by bonding, fusing, or interlocking to construct non-woven fabrics and felts. The second category includes textiles formed through a mechanical manipulation of yarn, thereby producing a woven fabric.

Yarn is the raw material utilized to form textiles in the second category and may be defined as an assembly having a substantial length and relatively small cross-section that is formed from at least one filament or a plurality of fibers. Fibers have a relatively short length and require spinning or twisting processes to produce a yarn of suitable length for use in textiles. Common examples of fibers are cotton and wool. Filaments, however, have an indefinite length and may merely be combined with other filaments to produce a yarn suitable for use in textiles. Modern filaments include a plurality of synthetic materials such as rayon, nylon, polyester, and polyacrylic, with silk being the primary, naturally-occurring exception. Yarn may be formed from a single filament or a plurality of individual filaments grouped together. Yarn may also include separate filaments formed from different materials, or the yarn may include filaments that are each formed from two or more different materials. Similar concepts also apply to yarns formed from fibers. Accordingly, yarns may have a variety of configurations that generally conform to the definition provided above.

The various techniques for mechanically manipulating yarn into a textile include interweaving, intertwining and twisting, and interlooping. Interweaving is the intersection of two yarns that cross and interweave at substantially right angles to each other. The yarns utilized in interweaving are conventionally referred to as warp and weft. Intertwining and twisting encompasses procedures such as braiding and knotting where yarns intertwine with each other to form a textile. Interlooping involves the formation of a plurality of columns of intermeshed loops, with knitting being the most common method of interlooping.

The manner in which a textile is formed, and the specific yarns incorporated into the textile, affect the characteristics of the textile and the suitability of the textile for use in articles of apparel for athletic activities. A tight weave, for example, may not be sufficiently permeable to permit the removal of perspiration. A tight weave, however, may be sufficient to block wind or precipitation. Accordingly, the suitability of a particular textile depends upon various factors relating to the particular activity and environmental conditions associated with the activity.

SUMMARY OF THE INVENTION

One aspect of the present invention is a flocked material having a substrate and a plurality of flocking fibers. The substrate is formed from a two-dimensional material and has a first surface and an opposite second surface. The flocking fibers are secured to the second surface. In addition, the flocking fibers may form a plurality of apertures that expose at least a portion of the second surface of the substrate. In some embodiments, the apertures may exhibit an elongate or elliptical configuration. The substrate may be a textile and may include a water-resistant coating.

Another aspect of the invention is an article of apparel that includes the flocked material. More particularly, the flocked material is incorporated into the article of apparel such that the flocking fibers face inward to form at least a portion of an interior surface of the article of apparel. The flocking fibers may be positioned to contact an individual wearing the article of apparel and form a space between the individual and the substrate.

The advantages and features of novelty characterizing the present invention are pointed out with particularity in the appended claims. To gain an improved understanding of the advantages and features of novelty, however, reference may be made to the following descriptive matter and accompanying drawings that describe and illustrate various embodiments and concepts related to the invention.

DESCRIPTION OF THE DRAWINGS

The foregoing Summary of the Invention, as well as the following Detailed Description of the Invention, will be better understood when read in conjunction with the accompanying drawings.

DETAILED DESCRIPTION OF THE INVENTION

Figure 1:
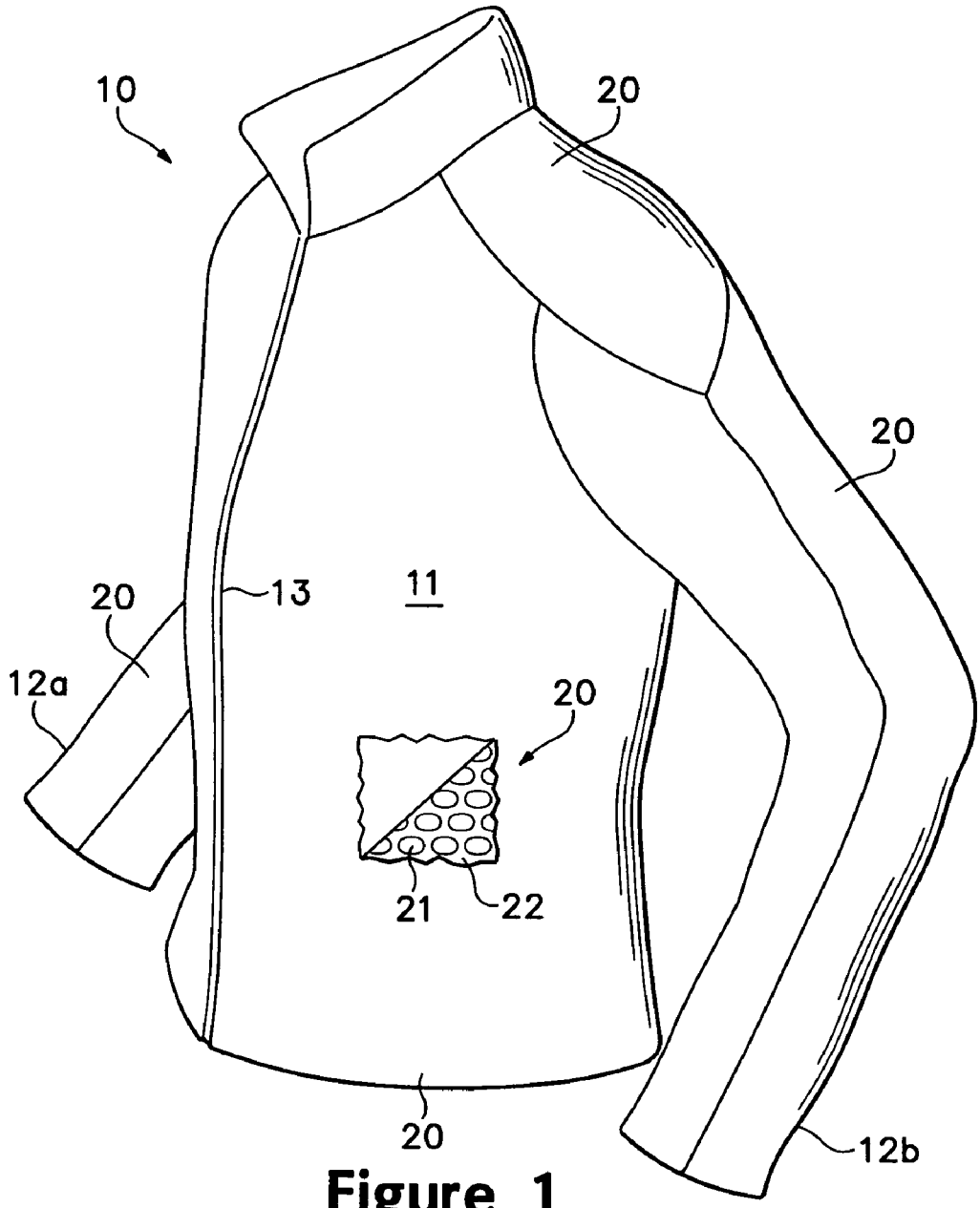
FIG. 1 is a perspective view of an article of apparel incorporating a material in accordance with the present invention.

The following discussion and accompanying figures disclose an article of apparel 10 at least partially formed from a flocked material 20, in accordance with the present invention. Article of apparel 10 is depicted in FIG. 1 as having the general configuration of a conventional jacket, with the exception of flocked material 20. One skilled in the relevant art will recognize, however, that flocked material 20 may be incorporated into a plurality of articles of apparel exhibiting a variety of different configurations, including long-sleeved and short-sleeved shirts, headwear, coats, pants, underwear, gloves, socks, and footwear, for example. Accordingly, the various concepts disclosed in the following discussion and accompanying figures with respect to article of apparel 10 may be utilized in connection with a variety of apparel configurations, in addition to a jacket.

Article of apparel 10 includes a torso portion 11 and two arm portions 12*a* and 12*b*. Torso portion 11 corresponds with a torso of an individual and, therefore, covers the torso when worn. Similarly, arm portions 12*a* and 12*b* respectively correspond with a right arm and a left arm of the individual and cover the arms when worn. A zipper 13 extends vertically through torso portion 11 to provide the individual with access to article of apparel 10. In addition, zipper 13 provides the individual with a structure for regulating the thermal properties of article of apparel 10. That is, zipper 13 may be opened to facilitate air flow and release heat, or closed to limit air flow. Article of apparel 10 exhibits, therefore, the general configuration of a conventional jacket. In contrast with the conventional jacket, however, article of apparel 10 is at least partially formed from flocked material 20.

Figure 2:
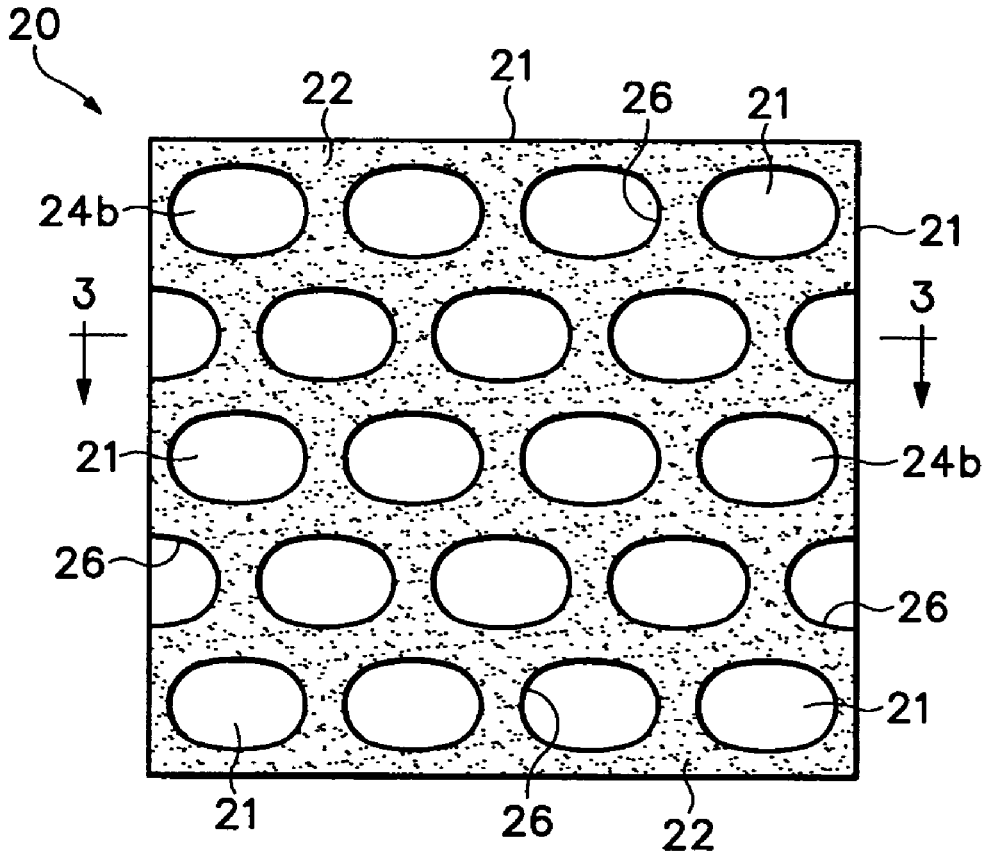
FIG. 2 is a plan view of a portion of the material.
Figure 3:
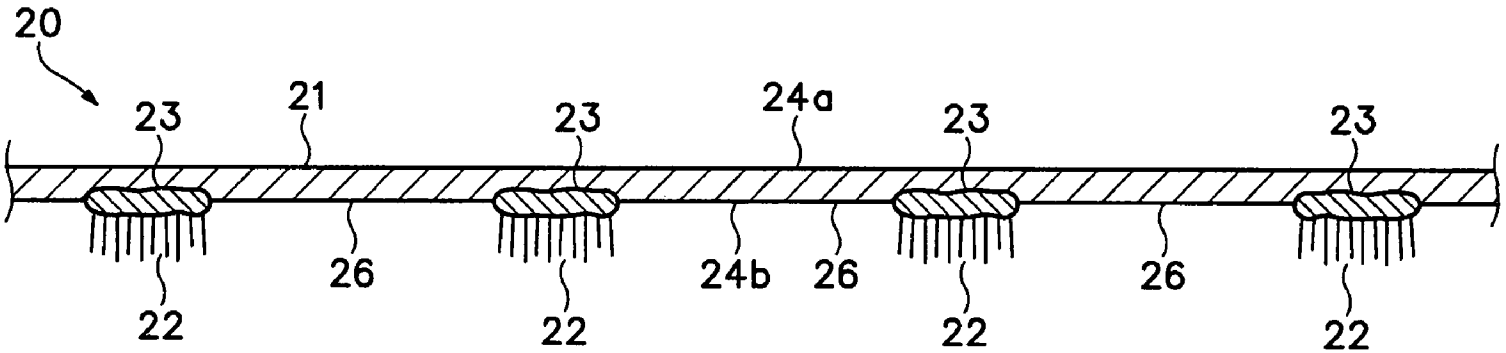
FIG. 3 is a cross-sectional view of the material, as defined by section line 3-3 in FIG. 2.

The primary elements of flocked material 20 are a substrate 21, a plurality of flocking fibers 22, and an adhesive 23, as depicted in FIGS. 2 and 3. Substrate 21 may be a textile or a polymer sheet, for example, that has a first surface 24*a* and an opposite second surface 24*b*. Flocking fibers 22 exhibit a perpendicular or otherwise substantially orthogonal orientation with respect to substrate 21, and flocking fibers 22 are secured to second surface 24*b* with adhesive 23. Accordingly, flocked material 20 has a configuration wherein flocking fibers 22 are perpendicularly-secured to substrate 21 with adhesive 23.

Figure 4:
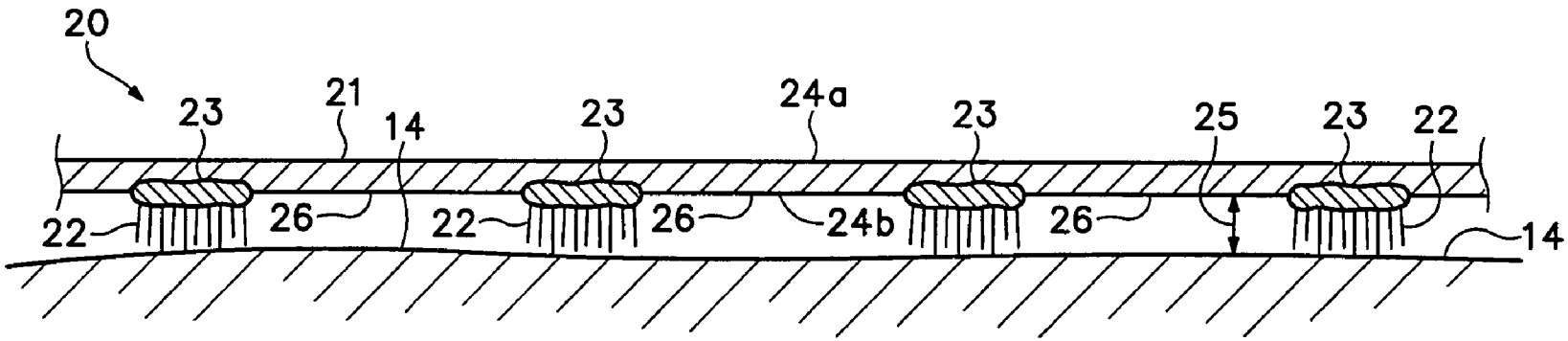
FIG. 4 is another cross-sectional view of the material that corresponds with FIG. 3 and depicts the material as being in contact with an individual.

Flocked material 20 is incorporated into article of apparel 10 such that first surface 24*a* faces outward and second surface 24*b* faces inward. That is, flocking fibers 22 are positioned in article of apparel 10 to form an interior surface of article of apparel 10 and contact the individual, which is represented by reference numeral 14 in FIG. 4. In many conventional articles of apparel that incorporate a flocked material, the flocked surface of the flocked material faces outward to provide an aesthetic quality to the conventional articles of apparel. In article of apparel 10, however, flocking fibers 22 and second surface 24*b* face inward in order to enhance the performance and comfort of the individual. More particularly, flocking fibers 22 contact the individual and form a space 25 between substrate 21 and the individual. Space 25 may enhance performance by facilitating the movement of air, thereby promoting removal of perspiration. Space 25 may also enhance comfort by retaining heat and ensuring that substrate 21 does not cling or otherwise significantly contact the individual. Accordingly, flocked material 20 is incorporated into article of apparel 10 such that flocking fibers 22 face inward, form space 25, and are positioned adjacent the individual.

Substrate 21 is formed from a generally two-dimensional material. As utilized with respect to the present invention, the term "two-dimensional material" is intended to encompass generally flat materials exhibiting a length and a width that are substantially greater than a thickness. Accordingly, suitable materials for substrate 21 include various textiles and polymer sheets, for example. Textiles, as discussed in the Background of the Invention section above, are generally manufactured from fibers, filaments, or yarns that are, for example, either (a) produced directly from webs of fibers by bonding, fusing, or interlocking to construct non-woven fabrics and felts or (b) formed through a mechanical manipulation of yarn to produce a woven fabric. Polymer sheets may be extruded, rolled, or otherwise formed from a polymer material to exhibit a generally flat aspect. In addition to textiles and polymer sheets, substrate 21 may be formed from other two-dimensional materials, such as leather and synthetic suede.

One suitable material for substrate 21 is a textile formed from a false twist textured polyester yarn having 75 and 72 filaments per yarn. Polyester is a hydrophobic material that also provides relatively high durability. Substrate 21 may be augmented with a durable, water-repellant material, such as a polytetrafluoroethylene coating. The specific characteristics of substrate 21 when formed from the polyester yarn are intended to provide an example of a suitable material for substrate 21. A variety of other materials are also suitable for substrate 21, including materials such as cotton, rayon, wool, and nylon, for example. The characteristics of substrate 21, when formed as a textile, depend primarily upon the materials of the yarns that form substrate 21. Cotton, for example, provides a soft hand, natural aesthetics, and biodegradability. Rayon provides high luster and moisture absorption. Wool also provides high moisture absorption, in addition to insulating properties. Nylon is a durable and abrasion-resistant material with high strength. Accordingly, the materials selected for substrate 21 contribute to the properties of article of apparel 10 and flocked material 20.

In order to provide stretch and recovery properties to flocked material 20, elastane fiber may be incorporated into substrate 21. Elastane fibers are available from E.I. duPont de Nemours Company under the LYCRA trademark. Such fibers may have the configuration of covered elastane, wherein the fiber includes an elastane core that is surrounded by a nylon sheath. Other fibers or filaments exhibiting elastic properties may also be utilized. A plurality of other materials, whether elastic or inelastic, are also suitable for substrate 21.

Flocking fibers 22 may be formed from any of the materials discussed above for substrate 21, in addition to a variety of other materials. One suitable material for flocking fibers 22 is a 1.5 denier nylon fiber having a length of approximately 0.5 millimeters. Within the scope of the present invention, however, flocking fibers 22 may vary in length from 0.2 millimeters to 5.0 millimeters, for example, and may exhibit a denier between 0.8 and 22. Accordingly, the specific configuration of flocking fibers 22 may vary significantly within the scope of the present invention.

Adhesive 23 securely joins flocking fibers 22 to substrate 21. A variety of adhesives may be utilized within the scope of the present invention. The specific adhesive selected for adhesive 23 should, however, continue to join flocking fibers 22 to substrate 21 through significant use and a plurality of washing cycles. Accordingly, a variety of adhesives may be utilized for adhesive 23.

Article of apparel 10 is formed from a plurality of individual elements that are joined together through stitching, for example, to form the configuration of a jacket. That is, multiple elements of flocked material 20 may be joined together to form torso portion 11 and arm portions 12*a* and 12*b*. Each of the individual elements may be formed from flocked material 20. As an alternative, one or more of the elements may be formed from different materials. For example, the elements forming torso portion 11 may be formed from flocked material 20, whereas the elements forming arm portions 12*a* and 12*b* may be formed from a different two-dimensional material. As another alternative, each of the elements forming article of apparel 10 may be formed from flocked material 20, but the specific material forming substrate 21 may vary. Accordingly, the manner in which flocked material 20 is incorporated into article of apparel 10 may vary significantly within the scope of the present invention.

Figure 5A:
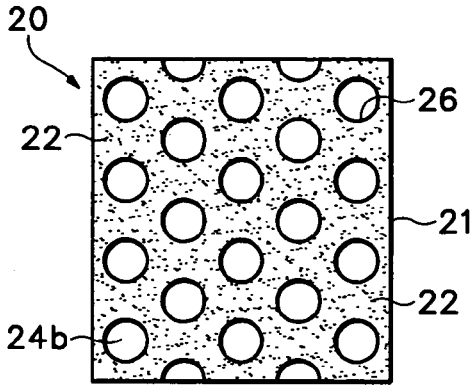
FIGS. 5A-5F are plan views depicting various additional configurations for the material.
Figure 5B:
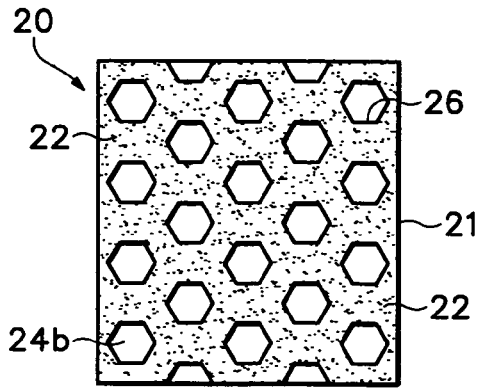
Figure 5C:
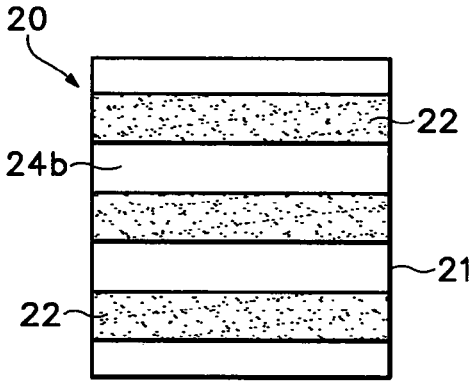
Figure 5D:
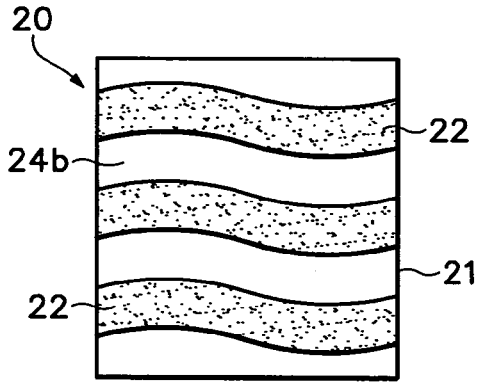
Figure 5E:
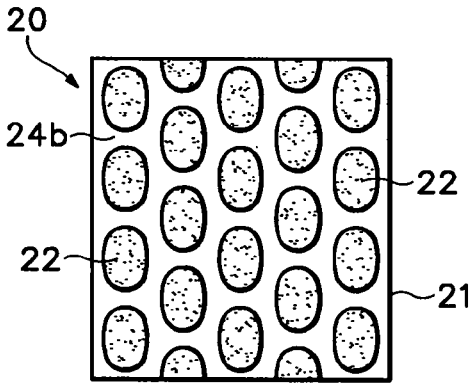
Figure 5F:
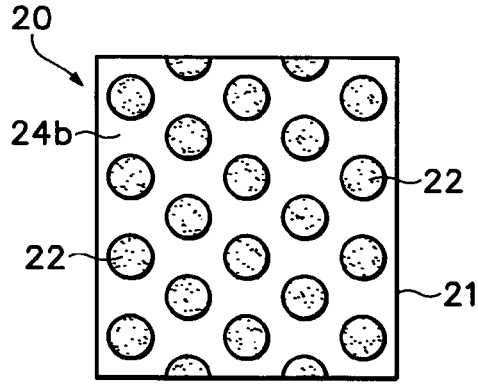

With reference to FIG. 2, the pattern of flocking fibers 22 on substrate 21 define a plurality of elongate apertures 26, with flocking fibers 22 extending entirely around apertures 26. As depicted, apertures 26 are elliptical in shape and have a width dimension that is approximately 70 percent a length dimension. Accordingly, the length of each aperture 26 may be approximately 10 millimeters, with the width being approximately 7 millimeters. The specific configuration of flocking fibers 22 on substrate 21 may vary significantly, however, as depicted in FIGS. 5A-5F. Flocking fibers 22 may form apertures 26 to have round or hexagonal shapes, for example, as depicted respectively in FIGS. 5A and 5B. Flocking fibers 22 may also form straight or curved lines on substrate 21, as depicted respectively in FIGS. 5C and 5D. In some embodiments, flocking fibers 22 may form discrete areas of flocking having elliptical or round shapes, as depicted respectively in FIGS. 5E and 5F.For instance, FIGS. 2-5F illustrate some embodiments having a first area and a plurality of second areas, wherein flocking fibers are connected to one of the first of second areas. For example, FIGS.2, 5A, and 5B illustrate some embodiments wherein the first aea 22 extends around the second areas 21 and the flocking fibers 22 are connected to the first area. Additionally or alternatively, FIGS. 3, 4, 5E, and 5F illustrate some embodiments wherein the first area 21 extends around the plurality of second areas 22 and the flocking fibers are connected to the plurality of second areas. In the arrangements shown, the flocking fibers 22 may be generally absent from the area to which they are not connected. In some other embodiments, flocking fibers 22 may even be randomly-placed such that no distinct pattern is formed on substrate 21. Accordingly, the shape of apertures 26 or the pattern of flocking fibers 22 may vary significantly within the scope of the present invention.

As discussed above, the pattern of flocking fibers 22 on substrate 21 define a plurality of elongate apertures 26, with flocking fibers 22 extending entirely around apertures 26. This configuration has advantages over configurations, including enhanced durability and grip characteristics. Regarding durability, flocking fibers 22 in this configuration remained intact on substrate 21 to a greater degree during washing when compared to materials having discrete areas of flocking fibers. In addition, this configuration may provide enhanced grip. Accordingly, flocked material 20 may be incorporated into gloves, for example, that are intended for use in gripping objects. More particularly, flocking fibers may be positioned on the exterior of a glove, such as a soccer goalkeeper glove, that is utilized for catching or otherwise handling a soccer ball.

Flocking fibers 22 contact the individual and form space 25 between substrate 21 and the individual, as discussed in detail above. One skilled in the relevant art will recognize that various factors cooperatively contribute to the proper formation of space 25, including the drape of substrate 21, the length of flocking fibers 22, and the dimensions and shape of apertures 26. The drape characteristic of substrate 21 may form a downward bow in each of apertures 26. The downward distance that substrate 21 extends is at least partially determined by the dimensions and shape of apertures 26. Accordingly, the length of flocking fibers 22 should be selected to be at least slightly longer than the downward distance that substrate 21 extends. If, for example, the downward distance that substrate 21 extends is greater than the length of flocking fibers 22, when substrate 21 may contact the individual and substantially limit the effectiveness of space 25. When designing flocked material 20, therefore, the drape of substrate 21, the length of flocking fibers 22, and the dimensions and shape of apertures 26 should be cooperatively considered in order to ensure that space 25 is properly formed.

Flocked material 20 may be formed through a generally conventional process. For example, the manufacturing process may initially involve placing adhesive 23 on substrate 21 in only those areas where flocking fibers 22 are intended to be located. As flocking fibers 22 contact adhesive 23, the various flocking fibers 22 may be aligned perpendicular to substrate 21 with an electrostatic charge. That is, the electrostatic charge may be utilized to impart the proper orientation to flocking fibers 22. End portions of flocking fibers 22 then contact adhesive 23 and are bonded with substrate 21 in the correct orientation. Flocked material 20 is then incorporated into article of apparel 10 such that flocking fibers 22 face inward, form space 25, and are positioned adjacent the individual.

Figure 6:
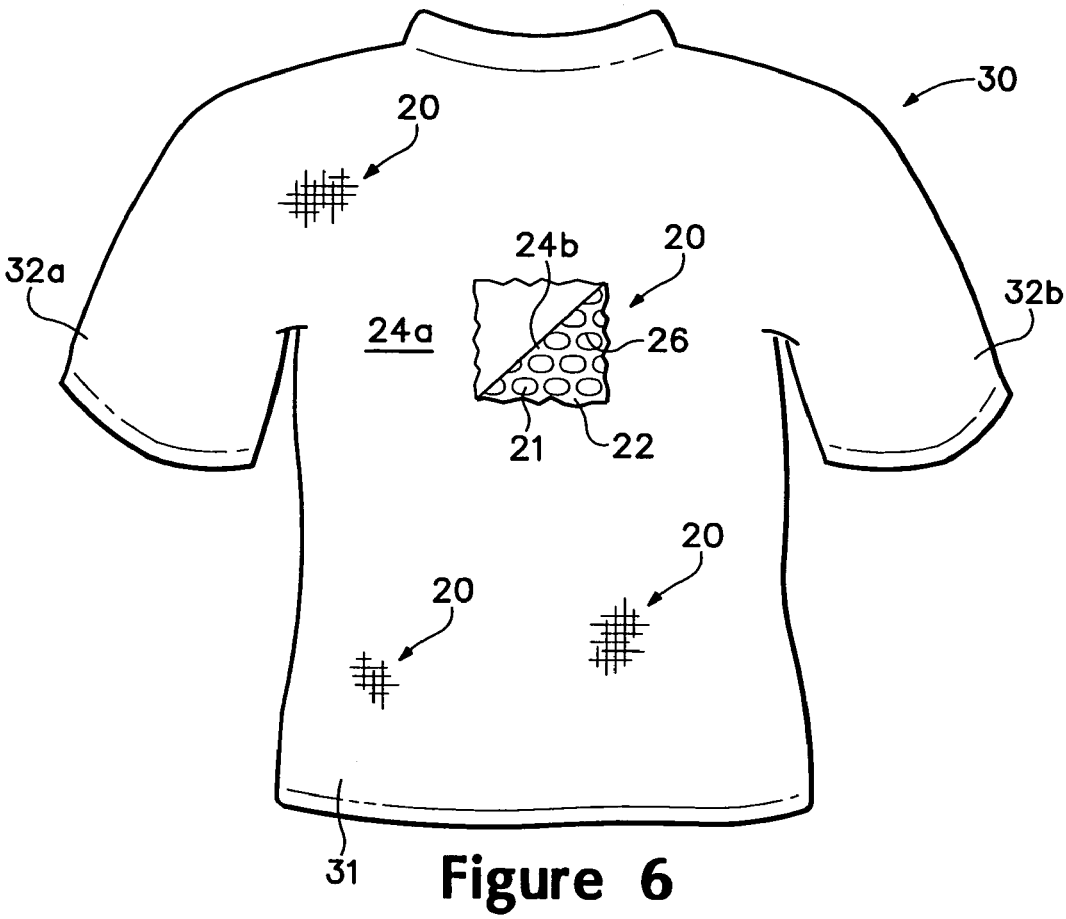
FIG. 6 is a front plan view of a another article of apparel incorporating the material.

With reference to FIG. 6, another article of apparel 30 is disclosed. Article of apparel 30 has the configuration of a short-sleeved shirt and includes a torso portion 31 and two arm portions 32*a* and 32*b*. Torso portion 31 corresponds with a torso of an individual and, therefore, covers the torso when worn. Similarly, arm portions 32*a* and 32*b* respectively correspond with a right arm and a left arm of the individual and cover the arms when worn. Article of apparel 30 exhibits, therefore, the general configuration of a conventional short-sleeved shirt. In contrast with the conventional short-sleeved shirt, however, article of apparel 30 is at least partially formed from flocked material 20. Accordingly, flocked material 20 is incorporated into article of apparel 30 such that first surface 24*a* faces outward and second surface 24*b* faces inward. That is, flocking fibers 22 are positioned in article of apparel 30 to contact the individual and form a space between substrate 21 and the individual.

Figure 7:
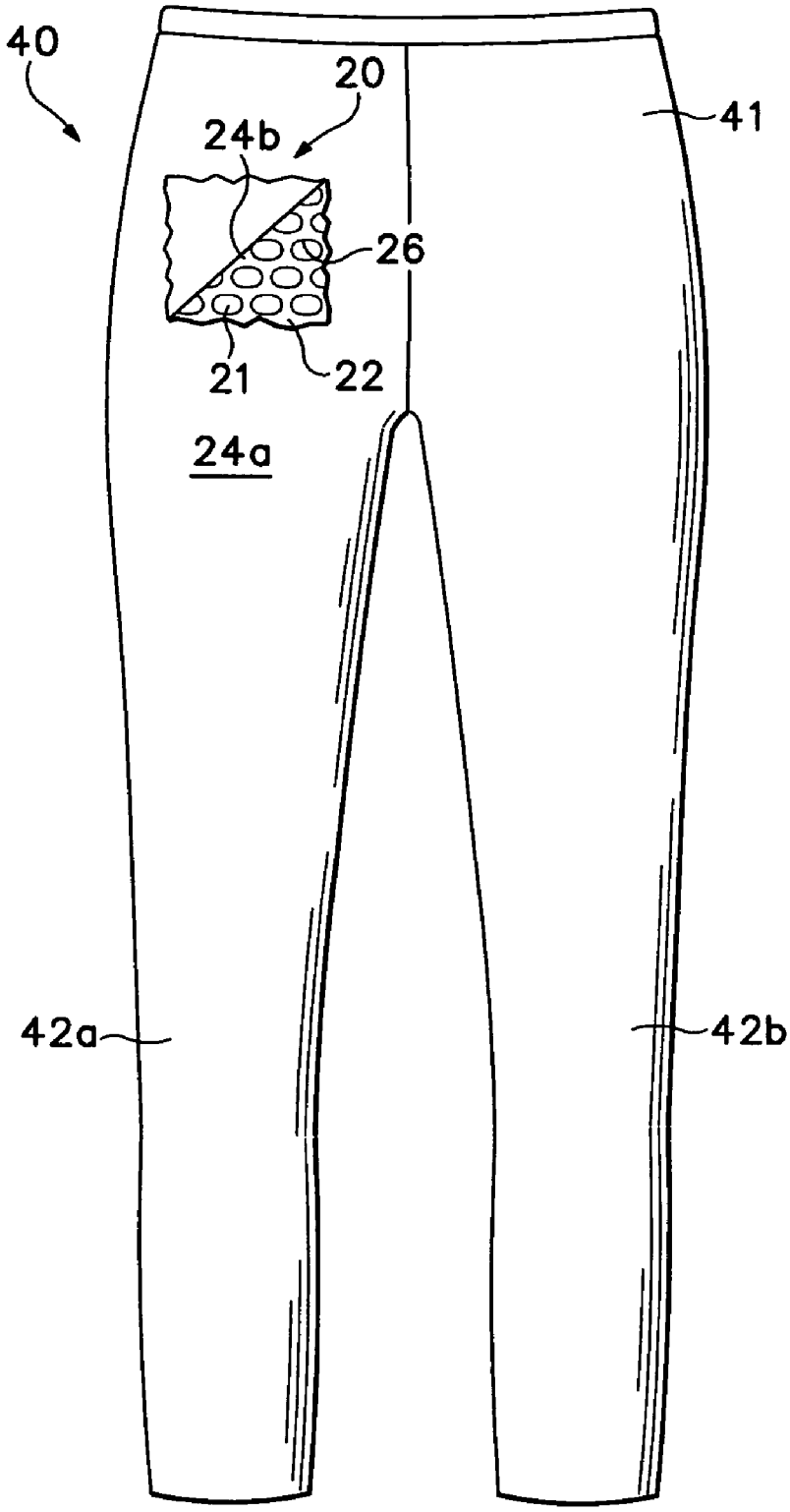
FIG. 7 is a front plan view of yet another article of apparel incorporating the material.

Another article of apparel 40 is depicted in FIG. 7 as having the configuration of a pair of pants. Article of apparel 40 includes a pelvic portion 41 and a pair of leg portions 42*a* and 42*b*. As with articles of apparel 10 and 30, article of apparel 40 incorporates flocked material 20 such that first surface 24*a* faces outward and second surface 24*b* faces inward. That is, flocking fibers 22 are positioned in article of apparel 40 to contact the individual and form a space between substrate 21 and the individual.

Based upon the above discussion, flocked material 20 may be incorporated into a variety of articles of apparel. The manner in which flocked material 20 is incorporated into articles of apparel may vary significantly within the scope of the present invention. In some embodiments, flocking fibers 22 are positioned to contact the individual. That is, the flocked portion of flocked material 20 faces inward. This configuration provides various advantages. For example, flocking fibers 22 contact the individual and form a space 25 between substrate 21 and the individual. Space 25 may enhance performance by facilitating the movement of air, thereby promoting removal of perspiration. Space 25 may also enhance comfort by retaining heat and ensuring that substrate 21 does not cling or otherwise significantly contact the individual. Accordingly, flocked material 20 may be incorporated into a variety of articles of apparel such that flocking fibers 22 face inward, form space 25, and are positioned adjacent the individual.

The present invention is disclosed above and in the accompanying drawings with reference to a variety of embodiments. The purpose served by the disclosure, however, is to provide an example of the various features and concepts related to the invention, not to limit the scope of the invention. One skilled in the relevant art will recognize that numerous variations and modifications may be made to the embodiments described above without departing from the scope of the present invention, as defined by the appended claims.

That which is claimed is:

1. An article of apparel comprising a flocked material with a plurality of flocking fibers forming a grouping of flocking fibers secured to at least one side, the flocked material being incorporated into the article of apparel such that the flocking fibers face inward to form at least a portion of an interior surface of the article of apparel, the side with the flocking fibers having a first area and a plurality of second areas, wherein the first area is a continuous area extending from a first edge of the side with the flocking fibers to a second edge of the side with the flocking fibers, the first area covering a majority of the at least one side and having a configuration that surrounds each of the second areas, the flocking fibers being secured to the first area and the flocking fibers being substantially absent from the second area, wherein the flocking fibers define an aperture in the at least one side.

2. The article of apparel recited in claim 1, wherein the flocked material also has a textile substrate, and the flocking fibers are secured to the textile substrate with an adhesive.

3. The article of apparel recited in claim 2, wherein the flocking fibers are positioned to contact an individual wearing the article of apparel and form a space between the individual and the textile substrate.

4. The article of apparel recited in claim 1, wherein the flocking fibers are positioned to contact an individual wearing the article of apparel.

5. The article of apparel recited in claim 1, wherein the flocking fibers are secured to the first area and form apertures in the first side that expose the second areas.

6. The article of apparel recited in claim 5, wherein the apertures have an elongate configuration.

7. The article of apparel recited in claim 5, wherein the apertures have an elliptical configuration.

8. The article of apparel recited in claim 1, wherein at least a portion of the flocked material includes a water-resistant coating.

9. The article of apparel recited in claim 1, wherein the flocking fibers are approximately 0.5 millimeters in length.

10. The article of apparel of claim 1, wherein each of the second areas has a circular configuration.

11. The article of apparel of claim 1, wherein each of the second areas has a configuration of a straight-sided polygon.

12. An article of apparel having a flocked material comprising:

a substrate formed from a two-dimensional material, the substrate having a first surface and an opposite second surface, the second surface having a continuous first area extending from a first edge of the second surface to a second edge of the second surface, the first area covering a majority of the second surface; and a plurality of flocking fibers secured to the first area of the second surface, the flocking fibers defining apertures in the second surface that expose a plurality of second areas of the second surface, each of the second areas surrounded by flocking fibers, wherein each of the second areas is not in contact with another second area, the apertures being discrete regions having a predefined shape, the flocked material being incorporated into the article of apparel such that the flocking fibers face inward to form at least a portion of an interior surface of the article of apparel.

13. The article of apparel recited in claim 12, wherein the substrate is a textile.

14. The article of apparel recited in claim 12, wherein the flocking fibers are positioned to contact an individual wearing the article of apparel.

15. The article of apparel recited in claim 12, wherein the substrate includes a water-resistant coating.

16. The article of apparel recited in claim 12, wherein the flocking fibers are secured to the second surface with an adhesive.

17. The article of apparel recited in claim 12, wherein the flocking fibers are approximately 0.5 millimeters in length.

18. A flocked material comprising:

a substrate formed from a two-dimensional material, the substrate having a first surface and an opposite second surface; and a plurality of flocking fibers secured to a continuous first area of the second surface, the first area extending from a first edge of the second surface to a second edge of the second surface, the flocking fibers forming a plurality of apertures that expose at least a portion of the second surface of the substrate, each of the apertures being a discrete region having a predefined shape and having a plurality of flocking fibers surrounding and defining the apertures, wherein each of the apertures is not in contact with another aperture, wherein a portion of the second surface to which the flocking fibers are secured is greater than the portion of the second surface exposed by the apertures.

19. The flocked material recited in claim 18, wherein the substrate is a textile.

20. The flocked material recited in claim 18, wherein the substrate includes a water-resistant coating.

21. The flocked material recited in claim 18, wherein the apertures have an elongate configuration.

22. The flocked material recited in claim 18, wherein the apertures have an elliptical configuration.

* * * * *